US010249188B2

(12) United States Patent
Liu

(10) Patent No.: US 10,249,188 B2
(45) Date of Patent: Apr. 2, 2019

(54) USER TERMINAL AND SAFETY CONTROLLING METHOD

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Cheng-Xiang Liu, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/722,341

(22) Filed: Oct. 2, 2017

(65) Prior Publication Data

US 2018/0190115 A1 Jul. 5, 2018

(30) Foreign Application Priority Data

Dec. 30, 2016 (CN) ..... 2016 1 1260161

(51) Int. Cl.

| | |
|---|---|
| ***G08G 1/095*** | (2006.01) |
| ***G08C 17/02*** | (2006.01) |
| ***G08G 1/16*** | (2006.01) |
| ***G08G 1/005*** | (2006.01) |
| ***G08G 1/04*** | (2006.01) |
| ***G08G 1/07*** | (2006.01) |

(52) U.S. Cl.

CPC ..... *G08G 1/095* (2013.01); *G08C 17/02* (2013.01); *G08G 1/005* (2013.01); *G08G 1/04* (2013.01); *G08G 1/07* (2013.01); *G08G 1/166* (2013.01)

(58) Field of Classification Search

None

See application file for complete search history.

(56) References Cited

U.S. PATENT DOCUMENTS

2018/0114435 A1* 4/2018 Singh ..... G08G 1/005

* cited by examiner

*Primary Examiner* — Adolf Dsouza

(74) *Attorney, Agent, or Firm* — ScienBiziP, P.C.

(57) ABSTRACT

A method applied to a pedestrian user terminal for road safety includes detecting whether a display device of the user terminal is in an active mode when predetermined signals are received by the user terminal. A prompt can be transmitted when the display device is in the active mode thus providing a warning to the pedestrian user to cross the road, on the display device he or she is viewing. The display device is deactivated when the display device is determined to be still in the active mode after a predetermined time period that starts from the prompt is transmitted.

10 Claims, 6 Drawing Sheets

USER TERMINAL AND SAFETY CONTROLLING METHOD

CROSS-REFERENCE TO RELATED APPLICATIONS

This application claims priority to Chinese Patent Application No. 201611260161.X filed on Dec. 30, 2016, the contents of which are incorporated by reference herein.

FIELD

The present disclosure relates to road safety, and particular to a user terminal and safety controlling method.

BACKGROUND

Generally, a pedestrian user may proceed to cross a zebra crossing when the pedestrian user is looking down at an electronic device. It is dangerous for the pedestrian user if he does not see an indicating light of the zebra crossing emitting red light.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
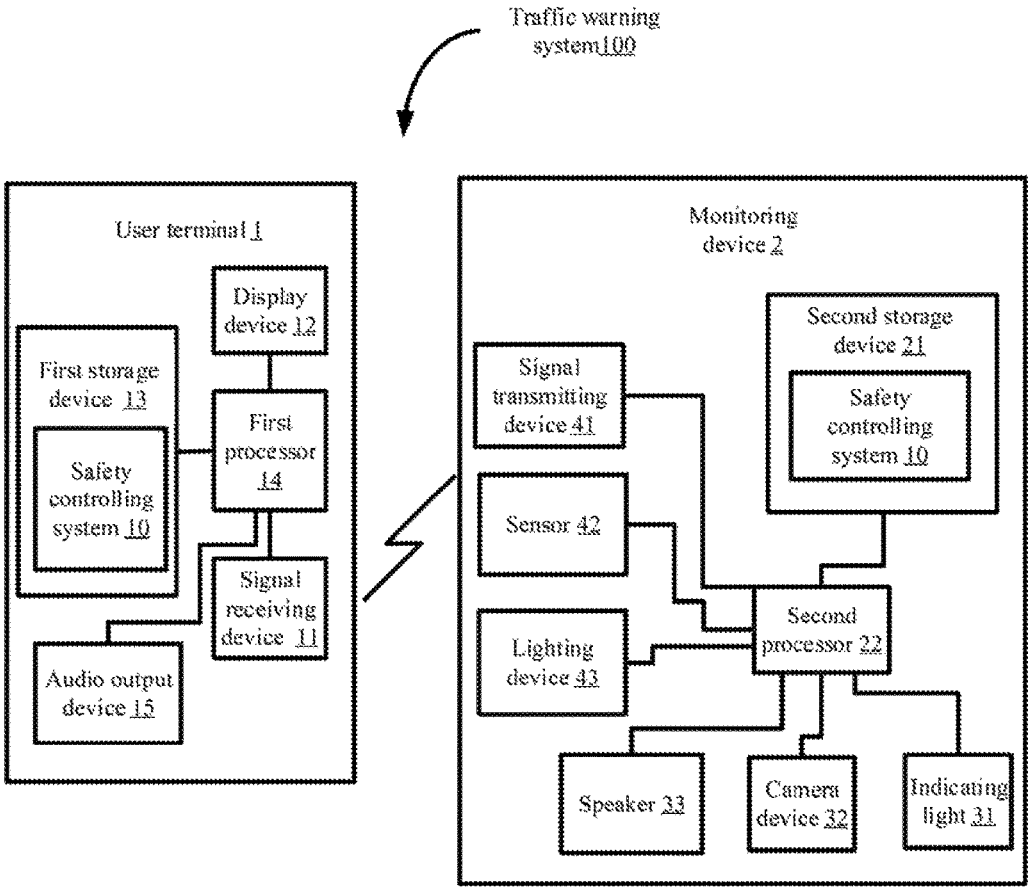
FIG. 1 is a block diagram of one exemplary embodiment of a traffic warning system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The present disclosure, referencing the accompanying drawings, is illustrated by way of examples and not by way of limitation. It should be noted that references to "an" or "one" embodiment in this disclosure are not necessarily to the same embodiment, and such references mean "at least one."

Furthermore, the term "module", as used herein, refers to logic embodied in hardware or firmware, or to a collection of software instructions, written in a programming language, such as Java, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media include CDs, DVDs, BLU-RAY, flash memory, and hard disk drives.

FIG. 1 is a block diagram of an exemplary embodiment of a traffic warning system 100. In the present embodiment, the traffic warning system 100 includes a user terminal 1 and a monitoring device 2. A safety controlling system 10 can be installed in the user terminal 1 and the monitoring device 2. When the safety controlling system 10 runs in the user terminal 1, the safety controlling system 10 can control the user terminal 1 to transmit a safety warning when a user of the user terminal 1 crosses a zebra crossing 4 shown in FIG. 2. When the safety controlling system 10 runs in the monitoring device 2, the safety controlling system 10 can control the monitoring device 2 to transmit a safety warning when pedestrians cross the zebra crossing 4.

In at least one exemplary embodiment, the user terminal 1 can include, but is not limited to, a signal receiving device 11, a display device 12, a first storage device 13, a first processor 14, and an audio output device 15. In at least one exemplary embodiment, the user terminal 1 can be a mobile phone, a tablet computer, or other suitable electronic devices.

Figure 2:
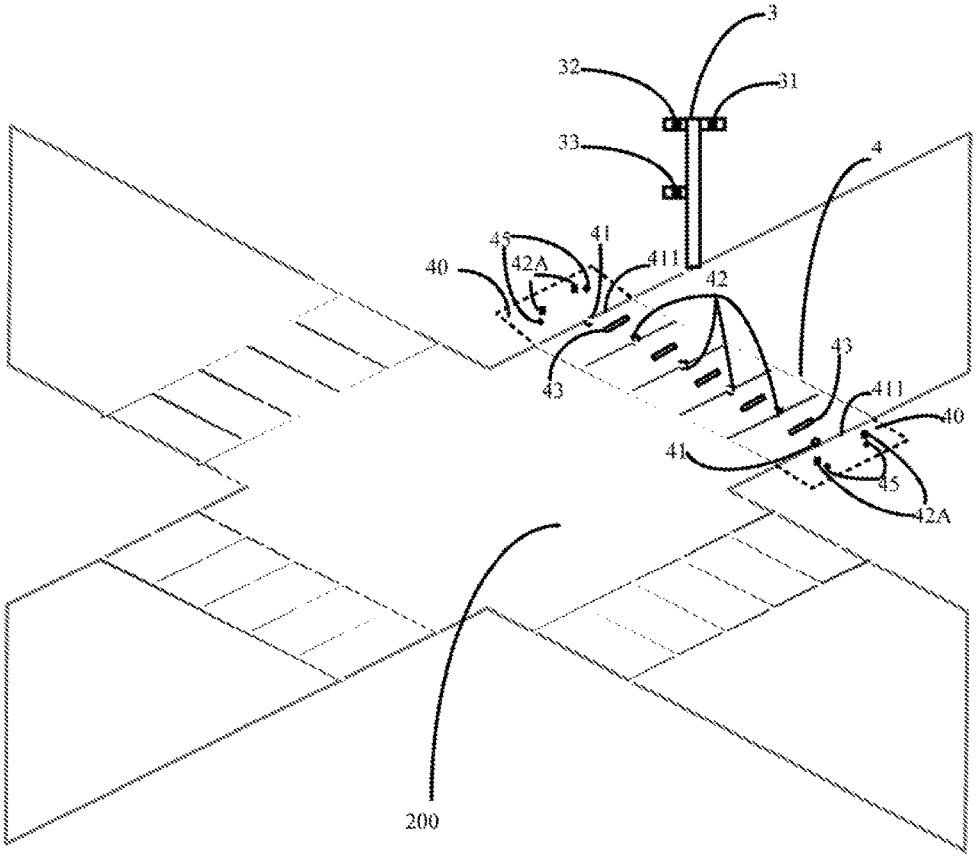
FIG. 2 illustrates an exemplary embodiment of configuration of elements at a zebra crossing.

In at least one exemplary embodiment, the monitoring device 2 can include, but is not limited to, a second storage device 21, a second processor 22, at least two signal transmitting devices 41, a first plurality of sensors 42, a plurality of lighting devices 43, an indicating light 31, a camera device 32, and a speaker 33. In at least one exemplary embodiment, as shown in FIG. 2, the monitoring device 2 can be installed on a bracket 3, the bracket 3 is fixed adjacent to the zebra crossing 4. In other exemplary embodiments, the monitoring device 2 can be fixed indoors. The monitoring device 2 can be a server or any other suitable devices having functions of storing and processing data.

In at least one exemplary embodiment, the at least two signal transmitting devices 41, the first plurality of sensors 42, and the plurality of lighting devices 43 can be underground where the zebra crossing 4 is located. The at least two signal transmitting devices 41, the first plurality of sensors 42, and the plurality of lighting devices 43 can wirelessly or in a wired manner communicate with the second processor 22.

In at least one exemplary embodiment, the signal transmitting device 41 can transmit predetermined signals. For example, when the signal transmitting device 41 is a near field communication (NFC) transmitter, the signal transmitting device 41 can transmit NFC signals at a fixed frequency. In at least one exemplary embodiment, the predetermined signals transmitted by the signal transmitting device 41 are effective within a distance (e.g., 1.5 meters). In at least one exemplary embodiment, as shown in FIG. 2, each of two ends 411 of the zebra crossing 4 is configured with at least one signal transmitting device 41, such that when a user carries the user terminal 1 from outside of the zebra crossing 4, the predetermined signals transmitted by the signal transmitting device 41 can be immediately received by the signal receiving device 11 of the user terminal 1. It should be noted that when the signal transmitting device 41 is an NFC transmitter, the signal receiving device 11 should be an NFC receiver.

In other exemplary embodiments, the predetermined signals can be radio frequency signals having predetermined frequency(ies). For example, the signal transmitting device 41 can be a radio frequency transmitter, and the signal receiving device 11 can be a radio frequency receiver.

The first plurality of sensors 42 can be used to detect the presence of pedestrians. In at least one exemplary embodiment, the first plurality of sensors 42 can be infrared sensors or gravity sensors. In at least one exemplary embodiment, a number of the first plurality of sensors 42 can be determined depending on a length and a width of the zebra crossing 4, and an effective distance of the sensor 42, as long as the pedestrian can be detected by the sensor 42 when the pedestrian is in any position within a range of the zebra crossing 4.

The plurality of lighting devices 43 can emit light of a variety of colors. In at least one exemplary embodiment, a number of the plurality of lighting devices 43 can be determined according to the length and the width of the zebra crossing 4, and a radius range of the lighting device 43, as long as when the pedestrian is within the range of the zebra crossing 4, the pedestrian can get noticed by the light emitted by the lighting device 43.

In at least one exemplary embodiment, the indicating light 31, the camera device 32, and the speaker 33 can be configured on the bracket 3. The indicating light 31, the camera device 32, and the speaker 33 can communicate wirelessly or by wires with the second processor 22.

The indicating light 31 can guide the pedestrian to cross or stop the pedestrian from crossing the zebra crossing 4 by emitting lights of different colors. For example, according to the traffic rule, when the indicating light 31 emits red light, the pedestrian cannot cross the zebra crossing 4. When the indicating light 31 emits green light, the pedestrian can cross the zebra crossing 4. The second processor 22 can control the indicating light 31 to emit red light or green light.

The camera device 32 can capture images or videos of a predetermined capture range. For example, when the camera device 32 faces towards the zebra crossing 4, the camera device 32 can capture images or videos of the pedestrians who cross the zebra crossing 4.

The speaker 33 can play sound. For example, the speaker 33 can play warning sounds.

In other exemplary embodiments, the indicating light 31, the camera device 32, and the speaker 33 can also be internally configured in the monitoring device 2, the monitoring device 2 can be configured on the bracket 3, and the indicating light 31, the camera device 32, and the speaker 33 can be configured to be face towards the zebra crossing 4.

In at least one exemplary embodiment, as shown in FIG. 2, waiting areas 40 are defined to be located along the ends 411 of the zebra crossing 4. A second plurality of sensors 42A and a plurality of motors 45 are underground where the waiting areas 40 are defined. Each of the second plurality of sensors 42A corresponds to one of the plurality of motors 45. The waiting area 40 can be defined to be an area where the pedestrian can wait when the indicating light 31 emits red light. The second plurality of sensors 42A and the plurality of motors 45 can communicate wirelessly or by wires with the second processor 22. It should be noted that the number of the second plurality of sensors 42A can be determined according to a size of the waiting area 40, as long as the pedestrian can be detected when the pedestrian waits in the waiting area 40. In at least one exemplary embodiment, when one of the second plurality of sensors 42A detects the pedestrian and the indicating light 31 emits red light, the second processor 22 can control the motor 45 corresponding to the sensor 42A that detects the pedestrian to vibrate underneath the pedestrian, such that the pedestrian can be warned not to cross the zebra crossing 4. It should be noted that FIG. 2 shows four crossings of crossroads 200. The present disclosure only illustrates elements configured for one of the four zebra crossings 4, i.e., the zebra crossing 4. The other three crossings can each have a similar configuration as described above.

In at least one exemplary embodiment, the first storage device 13 can be used to store data of the user terminal 1. For example, the first storage device 13 can store program codes of the safety controlling system 10 installed in the user terminal 1. In at least one exemplary embodiment, the first storage device 13 can be a memory of the user terminal 1 or can be external storage such as a secure digital card. In other exemplary embodiments, the first storage device 13 can also be a cloud storage device. Similarly, the second storage device 21 can be used to store all kinds of data of the monitoring device 2. For example, the second storage device 21 can store program codes of the safety controlling system 10 installed in the monitoring device 2. In at least one exemplary embodiment, the second storage device 21 can be a memory of the monitoring device 2 or can be external storage such as a secure digital card. In other exemplary embodiments, the second storage device 21 can also be a cloud storage device.

Figure 3:
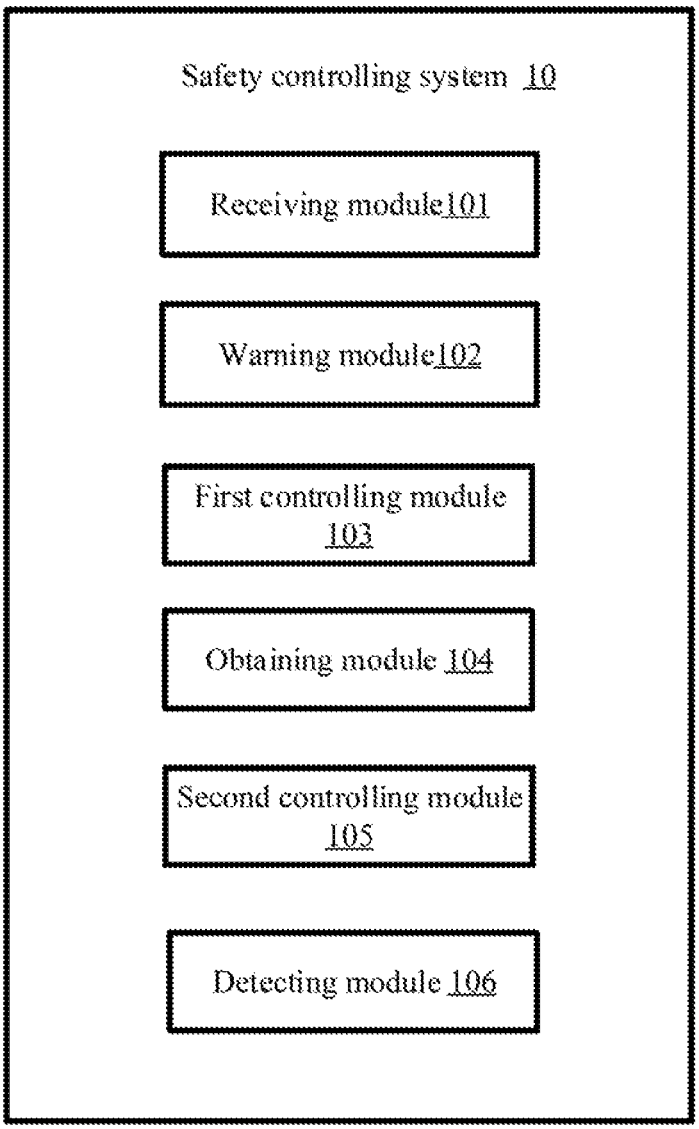
FIG. 3 is a block diagram of an exemplary embodiment of modules of a safety controlling system.

In at least one exemplary embodiment, as shown in FIG. 3, the safety controlling system 10 can include a receiving module 101, a warning module 102, a first controlling module 103, an obtaining module 104, a second controlling module 105, and a detecting module 106. The modules 101-106 include computerized codes in the form of one or more programs that may be stored in the first storage device 13 and the second storage device 21. The computerized codes include instructions that can be executed by the first processor 14 and the second processor 22.

In at least one exemplary embodiment, when the safety controlling system 10 runs in the user terminal 1, the safety controlling system 10 can include modules 101-103, and the first processor 14 can execute the modules 101-103. When the safety controlling system 10 runs in the monitoring device 2, the safety controlling system 10 can include the modules 104-106, and the second processor 22 can execute the modules 104-106.

In other exemplary embodiments, when the safety controlling system 10 runs in the user terminal 1, the safety controlling system 10 can include modules 101-106, and the first processor 14 can execute the modules 101-103. When the safety controlling system 10 runs in the monitoring device 2, the safety controlling system 10 can include the modules 101-106, and the second processor 22 can execute the modules 104-106.

Figure 4:
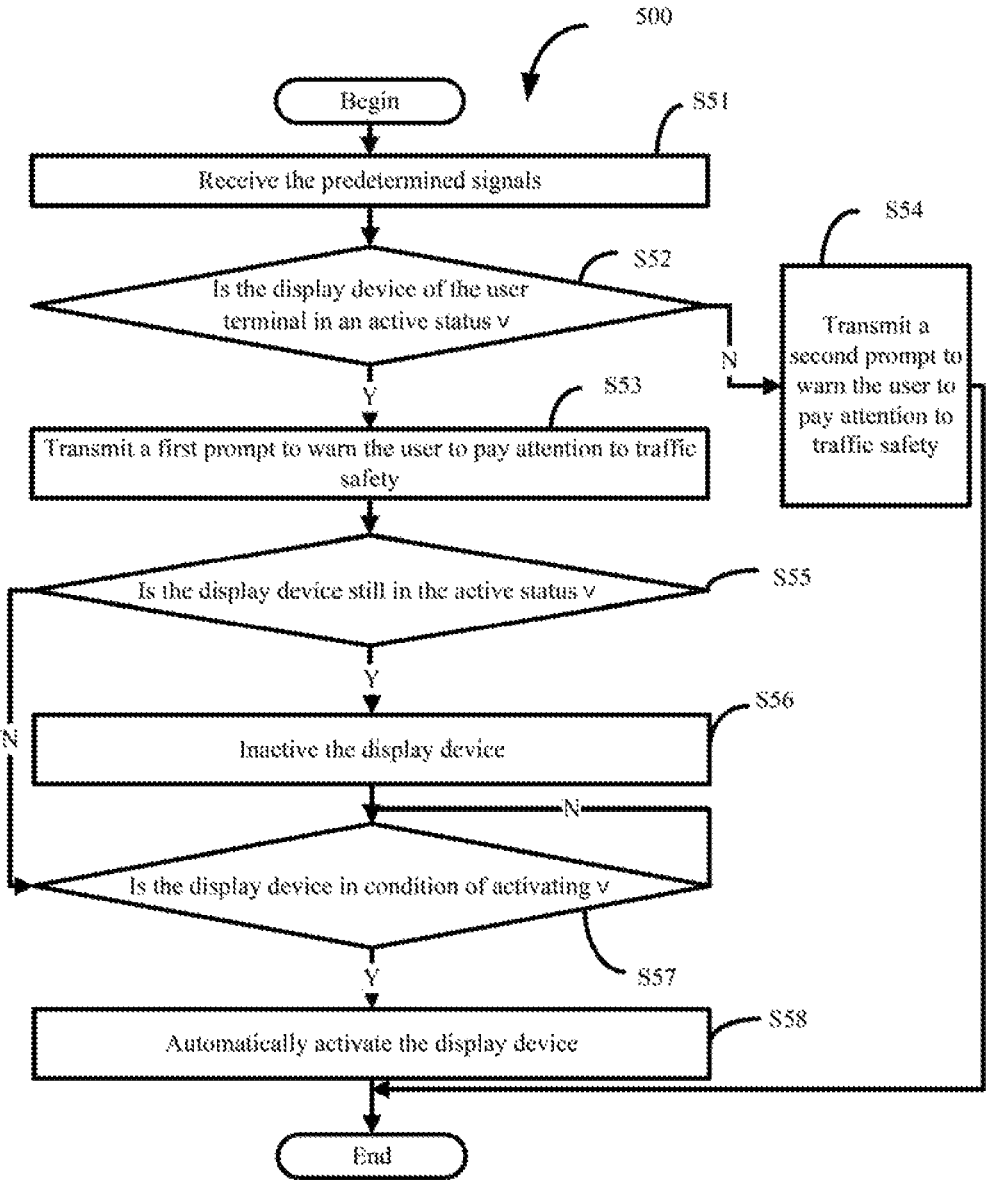
FIG. 4 illustrates a flowchart of an exemplary embodiment of a first safety controlling method that is applied to a user terminal.

FIG. 4 illustrates an exemplary embodiment of a first flowchart of a safety controlling method which is applied to the user terminal 1. The exemplary method 500 is provided by way of example, as there are a variety of ways to carry out the method. The method 500 described below can be carried out using the configurations illustrated in FIGS. 1-3, for example, and various elements of these figures are referenced in explaining exemplary method 500. Each block shown in FIG. 4 represents one or more processes, methods, or subroutines, carried out in the exemplary method 500. Additionally, the illustrated order of blocks is by example only and the order of the blocks can be changed. Depending on the embodiment, additional steps can be added, others removed, and the ordering of the steps can be changed.

At block S51, the receiving module 101 can receive the predetermined signals.

The receiving module 101 can receive the predetermined signals using the signal receiving device 11.

In at least one exemplary embodiment, the predetermined signals are NFC signals transmitted by the signal transmitting devices 41. The signal receiving device 11 can be an NFC receiver, and the signal transmitting device 41 can be an NFC transmitter.

In other exemplary embodiments, the predetermined signals can be radio-frequency signals having predetermined frequency(ies) that are transmitted by the signal transmitting devices 41. The signal transmitting device 41 can be a radio frequency transmitter, and the signal receiving device 11 can be a radio frequency receiver.

In at least one exemplary embodiment, each end 411 of the zebra crossing 4 is configured with at least one signal transmitting device 41. The monitoring device 2 can control the at least one signal transmitting device 41 to transmit the predetermined signals all the time. When the user carries the user terminal 1 and enters the range of the zebra crossing 4 from outside of the range of the zebra crossing 4, the signal receiving device 11 of the user terminal 1 can immediately receive the predetermined signals transmitted by the signal transmitting device 41.

At block S52, when the receiving module 101 receives the predetermined signals, the warning module 102 can detect whether the display device 12 of the user terminal 1 is in an active mode. In at least one exemplary embodiment, the active mode can be defined to the display device 12 is lighted by a backlight module of the display device 12. When the display device 12 of the user terminal 1 is in the active mode, the process goes to block S53. When the display device 12 of the user terminal 1 is not in the active mode (e.g., the backlight module of the display device 12 is off), the process goes to block S54.

At block S53, the warning module 102 can transmit a first prompt to warn the user to pay attention to traffic safety. For example, the warning module 102 can display a text message on the display device 12 like "please turn off display device and pay attention to traffic safety". When the block S53 is executed, the process goes to block S55.

At block S54, the warning module 102 can transmit a second prompt to warn the user to pay attention to traffic safety. For example, the warning module 102 can control the audio output device 15 of the user terminal 1 to output predetermined warning sounds.

In at least one exemplary embodiment, the audio output device 15 can be an earphone or a speaker.

In other exemplary embodiments, the block S54 can be optional.

At block S55, after a predetermined time period (e.g., 2 seconds), the first controlling module 103 can determine whether the display device 12 is still in an active mode. In at least one exemplary embodiment, the predetermined time period starts from the first prompt is transmitted. When the display device 12 is determined to be still in the active mode, the process goes to block S56. When the display device 12 is determined to be not in the active mode, the process goes to block S57.

At block S56, the first controlling module 103 can deactivate the display device 12. For example, the first controlling module 103 can turn off the backlight module of the display device 12.

At block S57, the first controlling module 103 can determine whether the display device 12 meets a predetermined condition. When the display device 12 does not meet the predetermined condition, the first controlling module 103 can keep the display device 12 in an inactivate mode (i.e., keep the backlight module of the display device 12 off). When the display device 12 meets the predetermined condition, the process goes to block S58.

In at least one exemplary embodiment, when the user of the user terminal 1 is determined to have left away from the zebra crossing 4, the first controlling module 103 can determine that the display device 12 meets the predetermined condition. In at least one exemplary embodiment, when the receiving module 101 receives the predetermined signals and then the receiving module 101 cannot receive the predetermined signals, and then again the receiving module 101 receives the predetermined signals, the first controlling module 103 can determine that the user of the user terminal 1 has left away from the zebra crossing 4.

At block S58, the first controlling module 103 can automatically activate the display device 12.

For example, the first controlling module 103 can activate the backlight module of the display device 12, such that the display device 12 is lit.

According to the above steps S51-S58, the safety controlling method can prompt the user of the user terminal 1 to pay attention to traffic safety when the user crosses the zebra crossing 4. It should be noted that the safety controlling method can also be applied to an entrance of a lift or a supermarket. When the signal transmitting device 41 is configured at the entrance of the lift or the supermarket, and the safety controlling system 10 is installed in the user terminal 1, the safety controlling method can be implemented.

Figure 5:
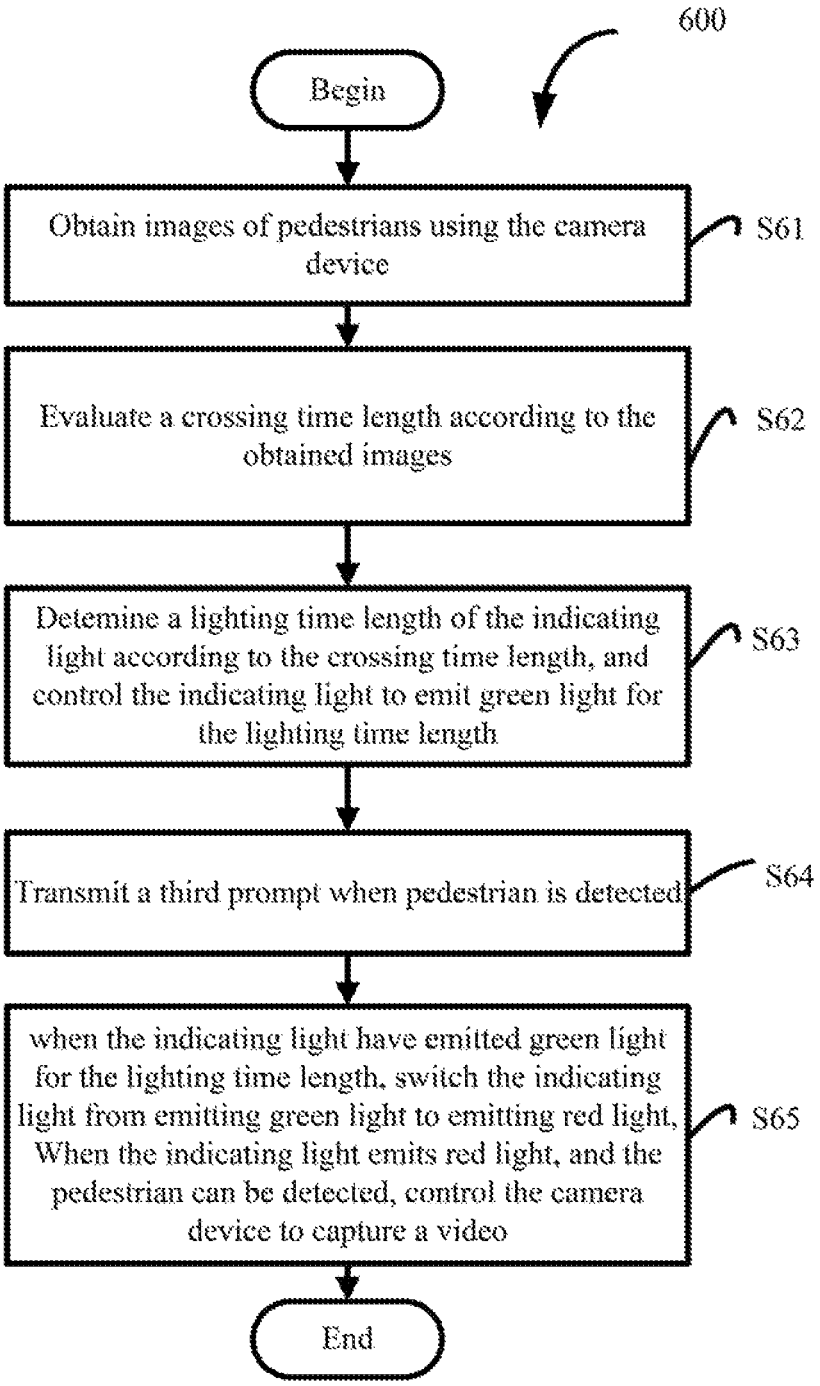
FIG. 5 illustrates a flowchart of an exemplary embodiment of a second safety controlling method that is applied to a monitoring device.

FIG. 5 illustrates an exemplary embodiment of a second flowchart of a safety controlling method which is applied to the monitoring device 2. The exemplary method 600 is provided by way of example, as there are a variety of ways to carry out the method. The method 600 described below can be carried out using the configurations illustrated in FIGS. 1-3, for example, and various elements of these figures are referenced in explaining exemplary method 600. Each block shown in FIG. 5 represents one or more processes, methods, or subroutines, carried out in the exemplary method 600. Additionally, the illustrated order of blocks is by example only and the order of the blocks can be changed according to the present disclosure. Depending on the embodiment, additional steps can be added, others removed, and the ordering of the steps can be changed.

At block S61, the obtaining module 104 can obtain images of pedestrians using the camera device 32.

In at least one exemplary embodiment, the images can be obtained within a predetermined time period. The predetermined time period can be a time period before the indicating light 31 is switched to emit green light. For example, the predetermined time period can be five seconds before the indicating light 31 emits green light. It should be noted that a capture range of the camera device 32 can include the waiting area 40.

At block S62, the obtaining module 104 can evaluate a crossing time length according to the obtained images. The crossing time length can be defined to be a time length that the pedestrians spend on crossing the zebra crossing 4.

Figure 6:
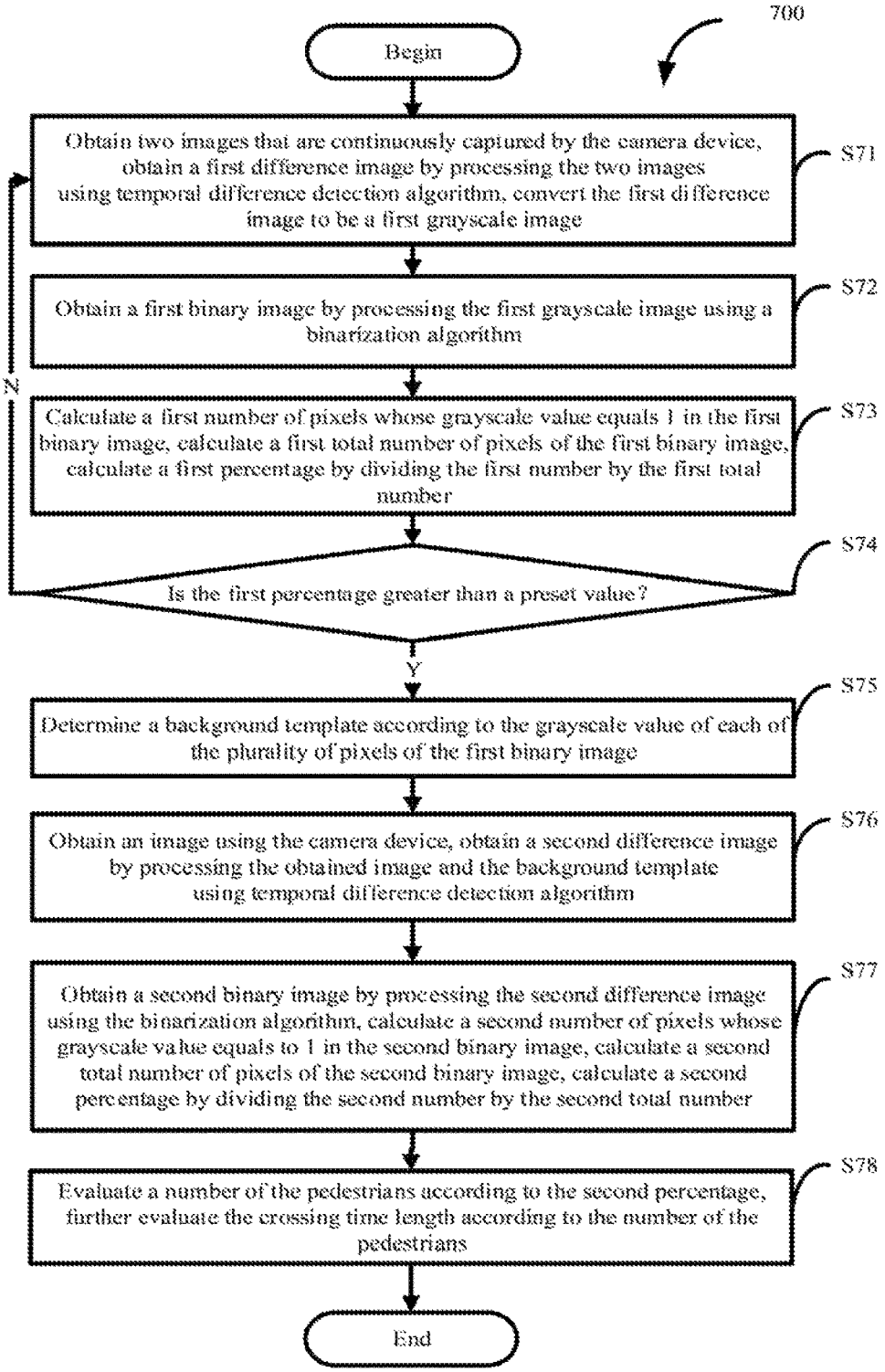
FIG. 6 illustrates a flowchart of an exemplary embodiment of a method of evaluating a length of time of pedestrian crossing the zebra crossing of FIG. 2.

Details of the evaluating of the crossing time length will be provided with reference to FIG. 6.

At block S63, the second controlling module 105 can determine a lighting time length of the indicating light 31 according to the crossing time length. The lighting time length can be defined to be a time length that the indicating light 31 emits green light. The second controlling module 105 can control the indicating light 31 to emit green light during the lighting time length.

In at least one exemplary embodiment, when the crossing time length is greater than a preset time length (e.g., 15 seconds), the second controlling module 105 can determine that the lighting time length equals the crossing time length. The second controlling module 105 can control the indicating light 31 to emit green light during the crossing time length.

In at least one exemplary embodiment, when the crossing time length is less than or equal to the preset time length, the second controlling module 105 can determine that the lighting time length equals the preset time length. The second controlling module 105 can control the indicating light 31 to emit green light for the preset time length. In other exemplary embodiments, when the crossing time length is less than or equal to the preset time length, the second controlling module 105 can determine that the lighting time length equals the crossing time length, and the second controlling module 105 can control the indicating light 31 to emit green light for the crossing time length.

At block S64, when the indicating light 31 emits green light, the pedestrians cross the zebra crossing 4. When the pedestrians enter the range of the zebra crossing 4, the pedestrians can be detected by the sensors 42 configured underground of the zebra crossing 4, such that the detecting module 106 can detect the pedestrians using the sensors 42. The second controlling module 105 can transmit a third prompt when the detecting module 106 detects the pedestrians.

In at least one exemplary embodiment, the second controlling module 105 can transmit the third prompt by activating the lighting device 43, such that light emitted by the lighting device 43 can be used to prompt the pedestrians to cross the zebra crossing 4 as soon as possible.

In other exemplary embodiments, the second controlling module 105 can transmit the third prompt by controlling the speaker 33 to play warning sounds, such that warning sounds can be used to prompt the pedestrians to cross the zebra crossing 4 as soon as possible.

In other exemplary embodiments, the second controlling module 105 can transmit the third prompt by controlling the speaker 33 to play warning sounds, and further activating the lighting device 43.

At block S65, when the indicating light 31 have emitted green light for the lighting time length, the second controlling module 105 can switch the indicating light 31 from emitting green light to emitting red light. In at least one exemplary embodiment, when the indicating light 31 emits red light, and the detecting module 106 can still detect the pedestrians, the second controlling module 105 can control the camera device 32 to capture a video. Such that when one or more pedestrians cross the zebra crossing 4 while the indicating light 31 emits red light, the video can be used as evidence.

FIG. 6 illustrates an exemplary embodiment of a flowchart of an exemplary method of calculating the crossing time length. The exemplary method 700 is provided by way of example, as there are a variety of ways to carry out the method. The method 700 described below can be carried out using the configurations illustrated in FIGS. 1-3, for example, and various elements of these figures are referenced in explaining exemplary method 700. Each block shown in FIG. 6 represents one or more processes, methods, or subroutines, carried out in the exemplary method 700. Additionally, the illustrated order of blocks is by example only and the order of the blocks can be changed according to the present disclosure. Depending on the embodiment, additional steps can be added, others removed, and the ordering of the steps can be changed.

At block S71, the obtaining module 104 can obtain two images that are continuously captured by the camera device 32. The obtaining module 104 can obtain a first difference image by processing the two images using a temporal difference detection algorithm. The obtaining module 104 can further convert the first difference image to a first grayscale image.

At block S72, the obtaining module 104 can obtain a first binary image by processing the first grayscale image using a binarization algorithm.

In at least one exemplary embodiment, the first grayscale image includes a plurality of pixels. If a grayscale value of any one of the plurality of pixels is not equal to 0, the obtaining module 104 can set the grayscale value of each pixel whose grayscale value is not equal to 0 in the first grayscale image to be 1. The obtaining module 104 can keep each pixel whose grayscale value equals 0 in the first grayscale image to be 0.

At block S73, the obtaining module 104 can calculate a first number of pixels whose grayscale value equals 1 in the first binary image. The obtaining module 104 can calculate a first total number of pixels of the first binary image. The obtaining module 104 can calculate a first percentage by dividing the first number by the first total number.

At block S74, the obtaining module 104 can determine whether the first percentage is greater than a preset value (e.g., 1%). When the first percentage is less than the preset value, the process goes to block S75. When the first percentage is greater than or equal to the preset value, the process goes to block S71.

At block S75, when the first percentage is less than the preset value, the obtaining module 104 can determine a background template according to the grayscale value of each of the plurality of pixels of the first binary image.

In at least one exemplary embodiment, the background template is an image that is determined according to an average value of the grayscale value of the plurality of pixels of the first binary image.

In other exemplary embodiments, the obtaining module 104 can obtain the background template by controlling the camera device 32 to capture an image when no pedestrian is in the zebra crossing 4 and no pedestrian is in the waiting area 40. The obtaining module 104 can set the captured image as the background template.

At block S76, the obtaining module 104 can obtain an image using the camera device 32. The obtaining module 104 can obtain a second difference image by processing the obtained image and the background template using a temporal difference detection algorithm.

At block S77, the obtaining module 104 can obtain a second binary image by processing the second difference image using the binarization algorithm.

In at least one exemplary embodiment, if a grayscale value of any one of a plurality of pixels of the second difference image is not equal to 0, the obtaining module 104 can set the grayscale value of each pixel whose grayscale value is not equal to 0 in the second difference image to be 1. The obtaining module 104 can keep each pixel whose grayscale value equals to 0 in the second difference image to be 0.

The obtaining module 104 can calculate a second number of pixels whose grayscale value equals to 1 in the second binary image. The obtaining module 104 can calculate a second total number of pixels of the second binary image. The obtaining module 104 can calculate a second percentage by dividing the second number by the second total number.

At block S78, the obtaining module 104 can evaluate a number of the pedestrians according to the second percentage. The obtaining module 104 can further evaluate the crossing time length according to the number of the pedestrians.

In at least one exemplary embodiments, the obtaining module 104 can pre-establish a table, the obtaining module 104 can record different percentages corresponding to different number of pedestrians in the table. The obtaining module 104 can further record different number of pedestrians corresponding to different crossing time lengths in the table. Such that when the second percentage is obtained, the obtaining module 104 can evaluate the crossing time length by searching the table according to the second percentage.

It should be emphasized that the above-described embodiments of the present disclosure, including any particular embodiments, are merely possible examples of implementations, set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. A safety controlling method applied to a user terminal, comprising:

detecting whether a display device of the user terminal is in an active mode when predetermined signals are received by the user terminal;

transmitting a prompt when the display device is in the active mode;

determining whether the display device is still in the active mode after a predetermined time period, wherein the predetermined time period starts from the prompt is transmitted;

deactivating the display device when the display device is determined to be still in the active mode; and activating the display device when the user terminal meets a predetermined condition, wherein the predetermined condition comprises the user terminal first receiving the predetermined signals and then the user terminal not receiving the predetermined signals, and then the user terminal again receiving the predetermined signals.

2. The safety controlling method according to claim 1, wherein the predetermined signals are near field communication (NFC) signals, or the predetermined signals are radio-frequency signals.

3. A user terminal, comprising:

a signal receiving device that receives predetermined signals;

a display device;

a storage device; and at least one processor;

the storage device storing one or more programs, which when executed by the at least one processor, cause the at least one processor to:

detect whether the display device is in an active mode when the predetermined signals are received;

transmit a prompt when the display device is in the active mode;

determine whether the display device is still in the active mode after a predetermined time period, wherein the predetermined time period starts from the prompt is transmitted;

deactivate the display device when the display device is determined to be still in the active mode; and activate the display device when the user terminal meets a predetermined condition, wherein the predetermined condition comprises the user terminal first receiving the predetermined signals and then the user terminal not receiving the predetermined signals, and then the user terminal again receiving the predetermined signals.

4. The user terminal according to claim 3, wherein the predetermined signals are near field communication (NFC) signals, or the predetermined signals are radio-frequency signals.

5. A safety controlling method applied to a monitoring device, the monitoring device comprising a camera device, an indicating light for guiding pedestrians to cross a zebra crossing, and at least one sensor that is configured for detecting the pedestrians when the pedestrians cross the zebra crossing, the method comprising:

obtaining images of the pedestrians using the camera device;

evaluating a crossing time length according to the obtained images, wherein the crossing time length is defined to be a time length that the pedestrians spend on crossing the zebra crossing;

determining a lighting time length of the indicating light according to the crossing time length;

controlling the indicating light to emit green light for the lighting time length; and transmitting a prompt when the sensor detects the pedestrian.

6. The safety controlling method according to claim 5, further comprising:

switching the indicating light from emitting green light to emitting red light when the indicating light have emitted green light for the lighting time length; and controlling the camera device to capture a video when the indicating light emits red light and the sensor detects the pedestrian.

7. The safety controlling method according to claim 5, wherein the transmitting of the prompt comprises:

controlling a speaker that is configured beside the zebra crossing to play warning sounds; and activating a lighting device that is underground configured at the zebra crossing.

8. The safety controlling method according to claim 5, wherein the evaluating of the crossing time length comprises:

obtaining a background template;

obtaining an image using the camera device;

obtaining a first difference image by processing the obtained image and the background template using temporal difference detection algorithm;

obtaining a first binary image by processing the first difference image using binarization algorithm;

calculating a first number of pixels whose grayscale value equals to 1 in the first binary image;

calculating a first total number of pixels of the first binary image;

calculating a first percentage by dividing the first number by the first total number;

evaluating a number of the pedestrians according to the first percentage; and evaluating the crossing time length according to the number of the pedestrians.

9. The safety controlling method according to claim 8, wherein the background template is obtained by controlling the camera device to capture an image when no pedestrian is in the zebra crossing.

10. The safety controlling method according to claim 8, wherein the background template is obtained by:

obtaining two images that are continuously captured by the camera device;

obtaining a second difference image by processing the two images using temporal difference detection algorithm;

converting the second difference image to be a second grayscale image;

obtaining a second binary image by processing the second grayscale image using the binarization algorithm;

calculating a second number of pixels whose grayscale value equals 1 in the second binary image;

calculating a second total number of pixels of the second binary image;

calculating a second percentage by dividing the second number by the second total number; and determining the background template according to an average value of the grayscale value of the pixels of the second binary image when the second percentage is less than a preset value.

* * * * *